US005377969A

United States Patent [19]

Steinhilber

[11] Patent Number: 5,377,969

[45] Date of Patent: Jan. 3, 1995

[54] METHOD AND DEVICE FOR SEPARATING SHEET-TYPE RECORDING MEDIA

[76] Inventor: Friedhelm Steinhilber, Schauinslandweg, D-7210 Rottweil, Germany

[21] Appl. No.: 943,174

[22] Filed: Sep. 11, 1992

[30] Foreign Application Priority Data

Sep. 24, 1991 [DE] Germany ..... 4131726

[51] Int. Cl.[6] ..... B65H 3/06

[52] U.S. Cl. ..... 271/21; 271/23; 271/114; 271/117

[58] Field of Search ..... 271/21, 22, 23, 117, 271/24, 25, 42, 131, 135, 114

[56] References Cited

U.S. PATENT DOCUMENTS

| | | | |
|---|---|---|---|
| 823,936 | 6/1906 | Dick | 271/23 |
| 1,127,991 | 2/1915 | Harbaugh | 271/42 |
| 2,062,643 | 12/1936 | Edmunds | 271/42 |
| 2,138,682 | 11/1938 | Storck | 271/42 X |
| 3,425,685 | 2/1969 | Liva | 271/21 |
| 4,290,593 | 9/1981 | Irvine | 271/42 |
| 4,928,947 | 5/1990 | Beery | 271/42 X |

FOREIGN PATENT DOCUMENTS

| | | |
|---|---|---|
| 493270 | 3/1930 | Germany . |
| 648721 | 8/1937 | Germany . |
| 663208 | 8/1938 | Germany . |
| 3535802 | 4/1987 | Germany . |
| WO89/03798 | 5/1989 | WIPO . |

*Primary Examiner*—Richard A. Schacher
*Attorney, Agent, or Firm*—Popham Haik Schnobrich & Kaufman, Ltd.

[57] ABSTRACT

To separate sheet-type recording media of different stiffnesses from a stack, a separating roller acts by friction on the current first sheet of the stack, in order to push it against a ramp and lift it up from the stack along this ramp. The separating roller is mounted in freely movable manner in a plane parallel to the plane of the stack, so that, as a function of the stiffness of the recording medium, it rolls over the stack and away from the ramp until the front edge of the sheet is able to bend sufficiently at the ramp to be separated. Thereby the separating roller adjusts automatically to the distance from the ramp that is optimum for the stiffness of the current recording media.

20 Claims, 4 Drawing Sheets

METHOD AND DEVICE FOR SEPARATING SHEET-TYPE RECORDING MEDIA

Figure 1:
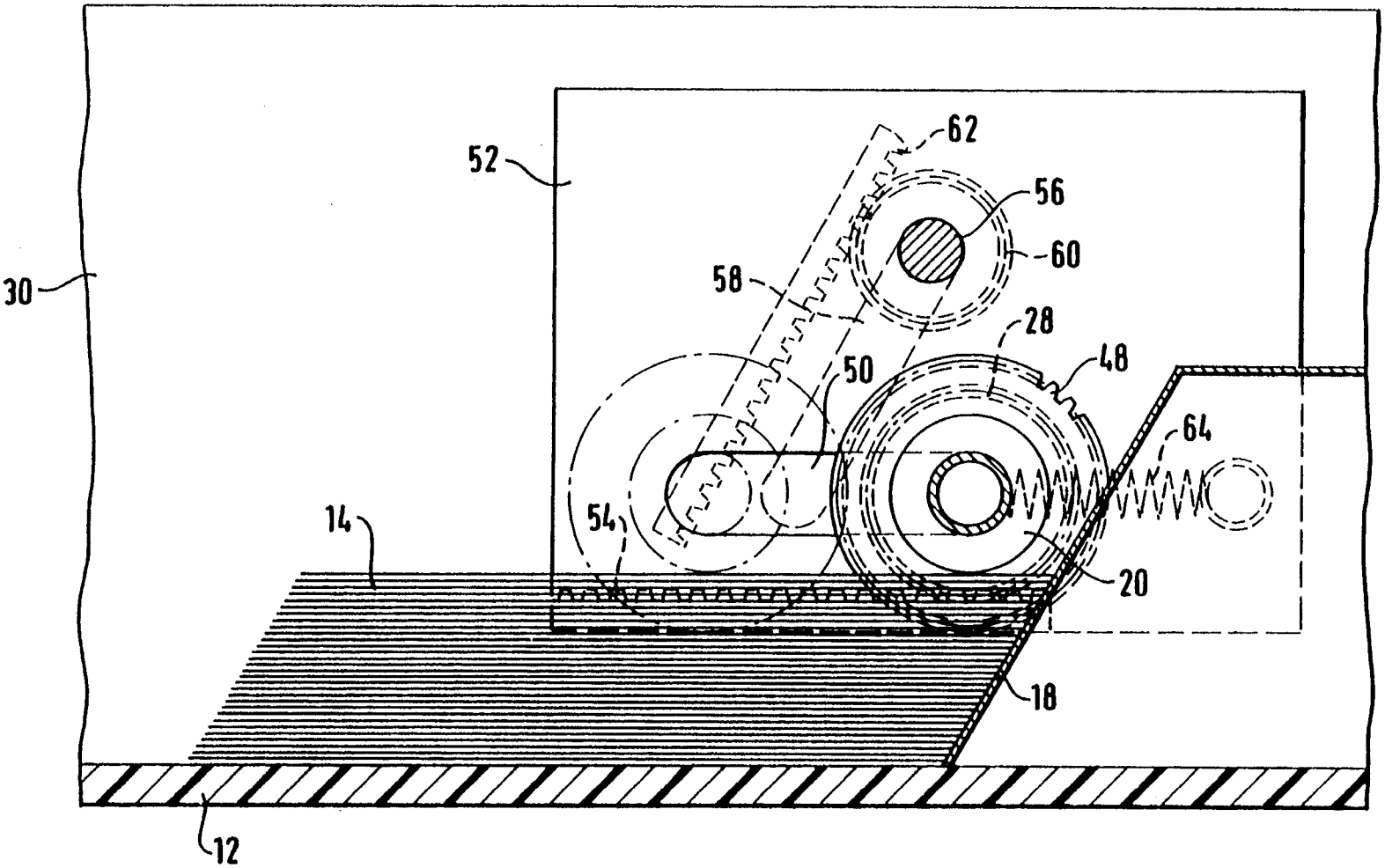

The invention relates to a method and apparatus for separating sheet-type recording media from a stack.

In many office machines, such as printers, copiers, etc., sheet-type recording media are kept ready in stacks, pulled individually from the stack and fed to the office machine for transfer of the recording. In the case of recording media of relatively slight stiffness, such as paper sheets, corner separators are generally used, which rest on the two front corners of the top sheet of the stack, thereby securing it. A separating roller acts by friction on the top sheet of the stack and pushes it against the corner separators, so that the sheet bulges upward, detaches from the underlying sheets of the stack and snaps forward beyond the corner separators. This type of separation can be used only for recording media of slight stiffness.

For recording media of greater stiffness, e.g., cards, envelopes, etc., it is known from German Patent 648,721 and from German Patent 663,208, for example, to place the stack on edge, in connection with which the support surface on which the stack rests is provided with a ramp in the region of the top sheets of the stack. The stack is pressed by a spring-loaded pressure plate against a separating roller, whereupon the top sheets of the stack arrive in the region of this ramp, along which their front edges become spread out, so that the top sheet can be pushed separately over the edge of the ramp. This type of separation is suitable only for recording media of sufficiently high stiffness. Sheets of slight stiffness cannot be spread out in a stable process, since they bend too severely.

From German Patent 3,535,802 C2, a device is known that combines corner separators with a ramp for the purpose of separation of paper sheets and stiff envelopes. The device is structurally complex, and adjustment of the corner separators necessary if the recording media are changed.

The object of the invention is to create a method and apparatus for separation of sheet-type recording media from a stack, which permit reliable separation of recording media of different stiffness with little structural complexity without necessitating adjustment of the device.

According to the invention, the stack of sheet-type recording media is placed with its front edge against a ramp. A separating roller rests on the stack and acts by friction on the recording media sheets, in order to push them against the ramp. In the process, the front edge of the sheet being pushed forward travels along the ramp and is thereby lifted up from the stack. In order that the front edge of the sheet being pushed forward can be pushed up along the ramp and lifted up from the stack, this sheet must be bent between the front edge which is against the ramp and the line along which the separating roller rests on the sheet. For such bending of the sheet to be possible, a sufficient distance must be provided between the ramp and the separating roller. This distance must be increased as a function of the stiffness of the recording medium, i.e., of the resistance with which the sheet opposes bending.

According to the invention, this distance between the ramp and the separating roller adjusts automatically to the optimum value corresponding to the stiffness of the recording medium. For this purpose, the separating roller is mounted in such a way that it can move freely away from the ramp over the stack of recording media. The separating roller first acts on the top sheet of the stack at a position immediately adjacent to the ramp. When the separating roller is driven in order to push this sheet by friction against the ramp, the front edge of the sheet can travel upward along the ramp and become separated only if the sheet has slight stiffness. The sheet of a stiffer recording medium exerts greater resistance to bending and thus has greater resistance to the travelling of the front edge upward along the ramp. This has the consequence that, instead of the sheet being pushed forward by the separating roller, the separating roller rolls away from the ramp by virtue of its frictional contact with the sheet and by virtue of its freely variable location on the sheet. In the process, the separating roller continues to roll away from the ramp until the sheet, by virtue of its stiffness, provides the separating roller with sufficient resistance to the driven roll-away movement. This resistance decreases progressively as the separating roller travels farther away from the ramp, since the sheet length available for bending of the sheet between front edge and separating roller increases. Once the separating roller has travelled so far away from the ramp that the sheet can bend between the ramp and the separating roller, the front edge of the sheet is pushed upward along the ramp and the sheet is pulled individually from the stack. When, after being pulled from the stack, the sheet is grasped and pulled in by the office machine, it carries the separating roller resting thereon back to its initial position on the ramp, by virtue of the freely movable location of the roller on the sheet. Thus the device is restored to its starting position for the next separation cycle.

While being driven, therefore, the separating roller automatically adjusts to that distance from the ramp which is necessary, as a function of the stiffness of the recording media, to allow these media to be lifted up and separated from the stack at the ramp. The device is therefore capable, without any kind of modifications, of reliably separating recording media of different stiffnesses, e.g., paper sheets of different thickness, cards, envelopes, etc.

In this connection, the term ramp should be understood as any inclined surface against which the top sheet pushes at an acute angle, so that a deflecting component of force acts on the front edge of the sheet as it is pushed forward against this surface, while the friction of the front edge at this surface counteracts the deflection. The ramp can therefore be an inclined planar surface, a curved surface or even the arc surface of a cylindrical roll, etc.

The freely variable location of the separating roller on the stack, as is necessary for separation according to the invention, can be achieved in different ways. The separating roller can be mounted on rocker arms, so that it can move over the stack by pivoting of these rocker arms. In order that the separating roller can travel over the plane upper surface of the stack, the pivoting movement of the separating roller must be sufficiently parallel to the stack upper surface, i.e., the rocker arms must be disposed as perpendicularly as possible to the upper surface of the stack and the swing radius of the separating roller must be sufficiently large relative to its movement distance over the stack. This construction is therefore suitable preferably for cases in which the recording media being separated do not have too large differences in stiffness, e.g., paper sheets of different thickness.

If recording media with greatly differing stiffness must also be separated, e.g., paper sheets, cards and envelopes, the separating roller is preferably guided in slideways running parallel to the stack surface. Thereby the range of movement of the separating roller parallel to the stack surface can be made sufficiently large for all stiffnesses of the recording media.

In order to prevent the situation that, during its movement, the separating roller becomes skewed relative to the sheet and its front edge lying against the ramp, the separating roller is expediently subjected to guidance parallel to the ramp. Such parallel guidance can be achieved in the case of mounting of the separating roller on rocker arms by providing that the rocker arms bearing the two ends of the separating roller are connected to each other in torsionally stiff relationship, e.g., by a transverse spindle. If the separating roller is guided by means of its two ends being in slideways, the parallel guidance can be achieved by providing that the separating roller is seated rotatably on a through-spindle, on the two ends of which nonrotatable pinions are attached, each engaging in a toothed section of the slideway.

In order to facilitate separation at the ramp, it is advantageous for the separating roller to act on the stack with the same contact pressure at all times regardless of the height of the stack of recording media. This is possible to only a limited extent if the contact pressure is exerted by spring force, since the spring force varies with the deflection of the spring and thus with the stack height. If the separating roller acts on the stack of recording media from above, it is therefore preferred to allow the separating roller to act on the stack under its own weight, which does not vary. For this purpose, the separating roller is mounted in a bearing unit that moves substantially vertically, so that it can freely follow the decreasing stack height and always rest on the stack under only its own weight plus the weight of this bearing unit. The weight of the separating roller plus bearing unit can be very small. This has a favorable influence on separation, since a low weight means a light contact pressure of the separating roller, and in turn the friction that exists between the first and second sheet of the stack and that opposes separation is kept slight.

If the separating roller acts from below on the stack of recording media, the first bottom sheet of the stack on which the separating roller acts always occupies the same position, and so the separating roller does not have to follow the stack height. Thus the contact pressure of the separating roller against the stack can be precisely adjusted, regardless of the stack height. In this case, however, it is expedient to place a pressure plate on the stack, to ensure the necessary minimum weight as thrust bearing for the separating roller even for the last sheets of the stack.

If the separating roller is mounted by means of rocker arms in the vertically movable bearing unit, the circular curvature of the movement path of the separating roller relative to the plane of the stack can also be compensated by the vertical movement of the bearing unit, so that in this case also the separating roller can move along the stack exactly parallel to the plane thereof.

As a rule, only one stack of identical recording media is loaded in the device at any one time, for example, a stack of paper sheets or a stack of envelopes. However, the device can also separate stacks that contain sheets of different stiffness, for example alternating paper sheets or cards and envelopes. Since the separating roller returns to its initial position at the ramp after each separation cycle, it readjusts to the appropriate distance for every sheet of the stack. Such restoration of the separating roller to the initial position can be supported by a restoring spring. If the stack has an orientation inclined to the horizontal in the device, so that the path of movement of the separating roller is also inclined, the restoration to the initial position can also be effected by the dead weight of the separating roller. In these cases, a freewheel is preferably provided in the drive of the separating roller, to enable the separating roller to travel back freely on the stack under the action of the restoring force and independently of the drive connection.

The drive of the separating roller is provided preferably through a toothed-gear mechanism that engages in a toothed gear seated on the separating roller. In order that reliable engagement of the teeth is ensured despite the movement of the separating roller, the last toothed gear of the toothed-gear mechanism, which meshes with the toothed gear of the separating roller, is expediently mounted on a pivotable bearing arm that rotatably encircles the spindle of the separating roller. If the separating roller is mounted on rocker arms, this bearing arm can be one of these rocker arms.

In most practical applications, it is desirable to take the drive of the separating roller from a fixed drive shaft. In this case, it can be expedient to mount the toothed-gear mechanism on at least two flexibly interconnected arms, a toothed gear of the toothed-gear mechanism being disposed at each of the hinge points connecting the arms. The last of these arms is therefore the bearing arm that encircles the spindle of the separating roller with its free end. This construction of the toothed-gear mechanism permits a toothed-gear connection between the fixed drive shaft and the separating roller, which is movable in two dimensions.

If the device for feeding recording media is used for a printer, it can be built onto the printer or integrated therein, in which case the fixed drive shaft is preferably in driving connection with the platen of the printer, so that the drive and control of the separation process can be effected by the platen control system of the printer.

Figure 2:
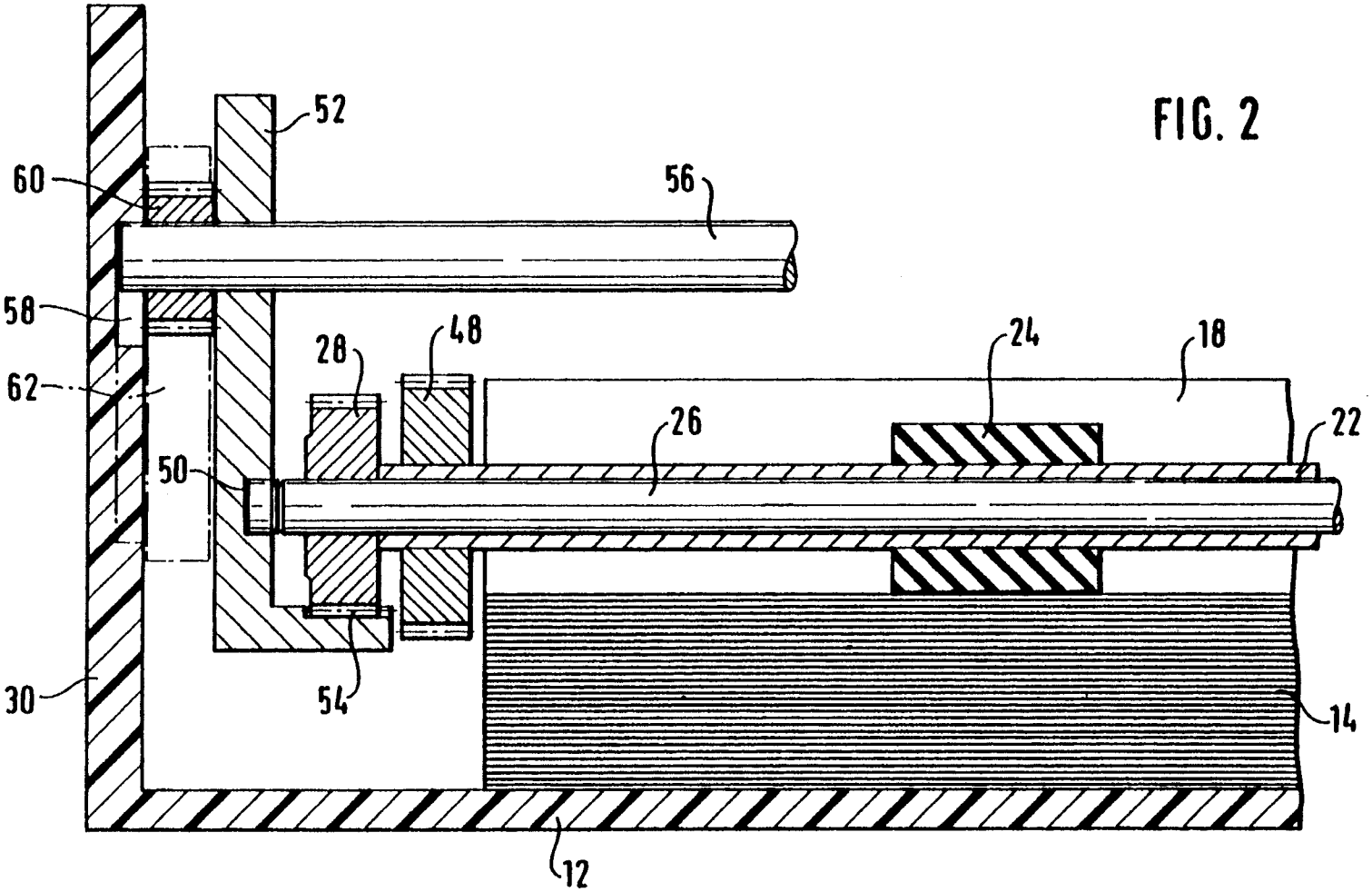
Figure 3:
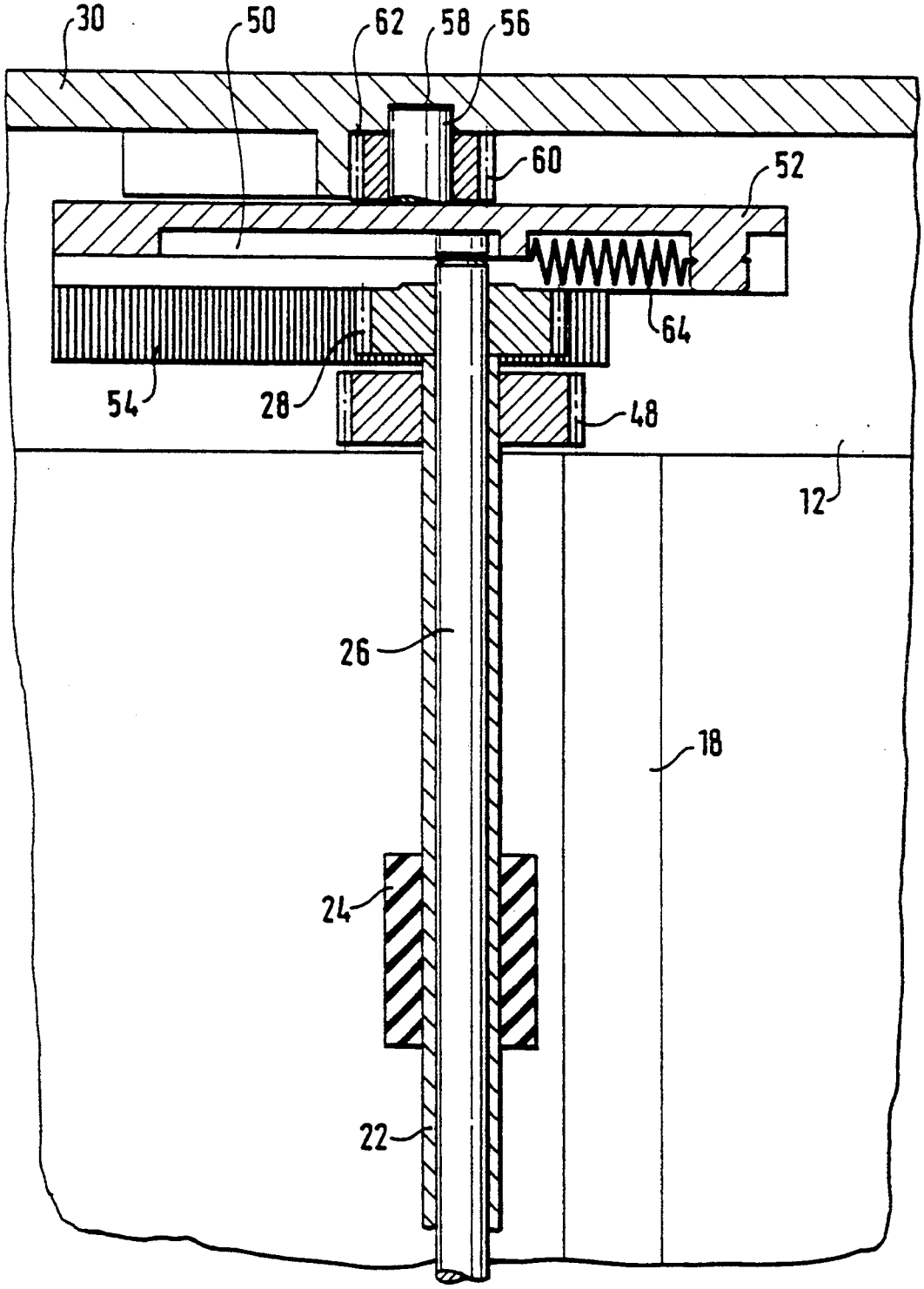
Figure 4:
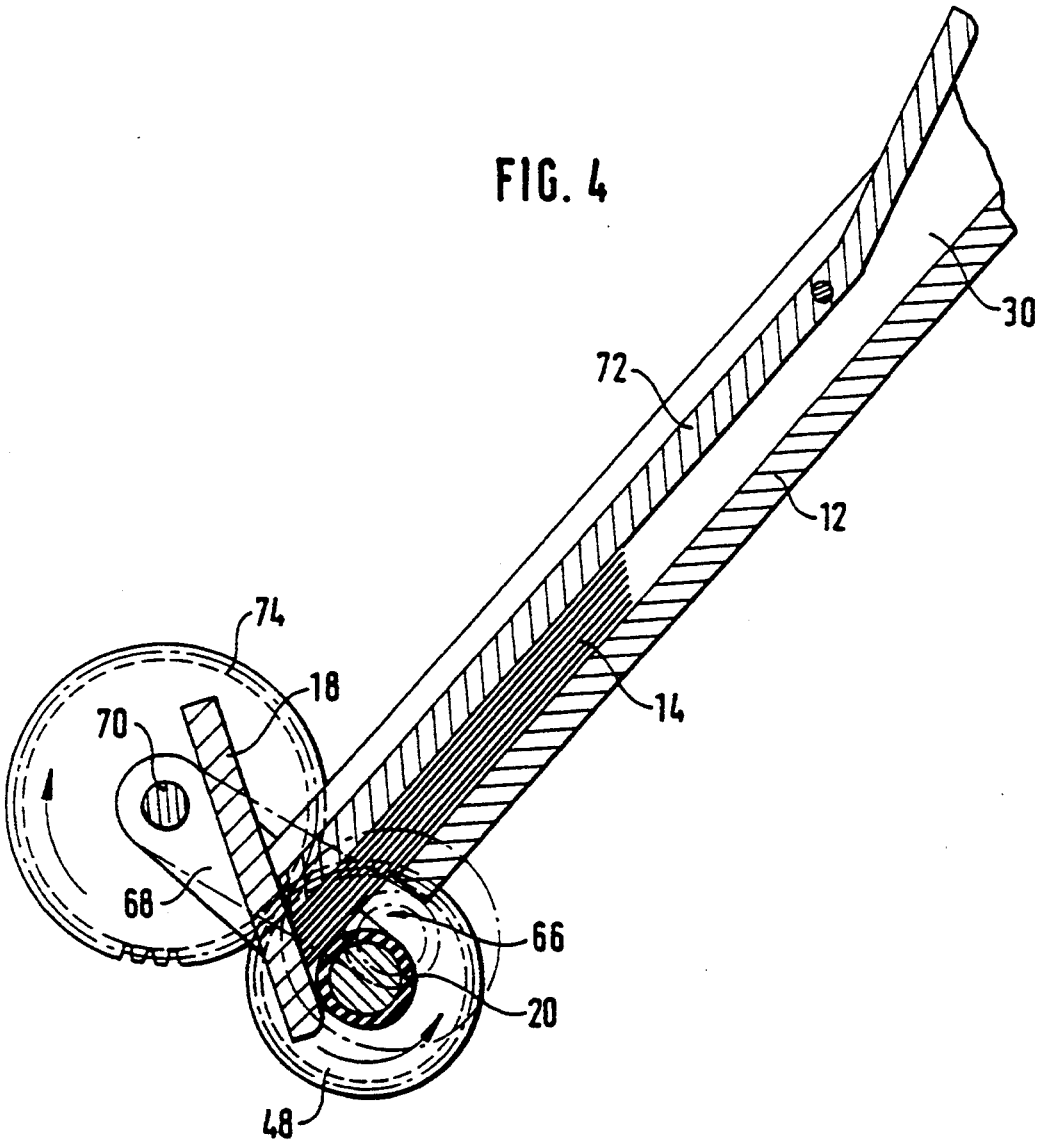

The invention will be described in more detail in the following, by reference to practical examples illustrated in the drawing, wherein FIG. 1 shows a vertical partial longitudinal section through the device according to the invention in a first embodiment, FIG. 2 shows a partial cross section through this device, FIG. 3 shows a partial top view of this device and FIG. 4 shows a vertical partial longitudinal section through the device in a second embodiment.

In the practical example of FIGS. 1 to 3, the device has a box-like housing in the form of an open-top plastic trough, on the substantially horizontal bottom 12 of which the stack of recording media 14 is placed flat. Diagonally in the housing there is inserted a ramp 18, which is oriented up and away from the bottom 12 and from the stack of recording media 14 toward the transverse wall of the housing. The height of the ramp 18 is at least approximately larger than the maximum anticipated height of the stack of recording media 14.

The stack of recording media 14 is placed with its front transverse edge against the ramp 18. On the stack there rests a separating roller 20, which extends parallel to the plane of the stack, parallel to the slope 18 and across the recording media 14. The separating roller 20 consists of a tube 22, which is mounted rotatably on a through-spindle 26 and on its outer periphery carries friction roller pads 24, which act frictionally on the recording media 14.

The two ends of the spindle 26 of the separating roller 20 protruding from the tube 20 are each guided in a slideway 50 of a bearing unit 52, which has the form of a vertical plate adjacent to the side wall 30 of the housing. The slideways 50 are disposed horizontally and thus parallel to the plane of the stack of recording media 14. Under the slideways 50 and parallel thereto there are disposed toothed sections 54, each mounted on a flange of the bearing unit 52, with each of which toothed sections there meshes a toothed pinion 28, which is seated nonrotatably on the end of the spindle 26.

The separating roller 20, guided by means of its spindle 26 in the slideways 50, is movable in a horizontal plane parallel to the plane of the stack of recording media 14, the engagement of the toothed pinion 28 in the toothed sections 54 bringing about compulsory guidance, which ensures that the separating roller 20 will always occupy a position parallel to the ramp 18 during this movement.

The bearing unit 52 has a transverse, freely rotatable through-spindle 56 mounted in the plates adjacent to each of the side walls 30, the ends of which spindle engage in slideways 58 formed in the side walls 30. On each end of the transverse spindle 56 there is seated a nonrotatable toothed pinion 60, which meshes with a toothed section 62 disposed on the slideway 58. The slideways 58 in the side walls 30 are disposed parallel to the slope of the ramp 18. The bearing unit 52 together with the separating roller 20 can be moved vertically up and down in the slideways 58, whereupon the toothed pinions 60 meshed with the toothed sections 62 bring about compulsory guidance, thus ensuring that the separating roller 20 always occupies a position parallel to the surface of the stack of recording media 14.

A restoring spring 64 is fixed with one end to the spindle 26 of the separating roller 20 and with its other end to a pin fixed in position in the housing, and this spring pulls the separating roller 20 toward the ramp 18 at the nearest end of the slideway 50.

In the initial position illustrated in FIG. 1, the separating roller 20 rests under its own weight plus the weight of the bearing unit 52 on top of the stack of recording media 14, since the bearing unit 52 is guided in freely movable manner in the slideway 58. The restoring spring 64 holds the separating roller 20 in the position closest to the ramp 18, in which position the separating roller 20 acts on the top sheet of the stack at its very front edge, with which this sheet is placed against the ramp 18.

The separating roller 20 is now set in counterclockwise rotation (in the diagram of FIG. 1) by means of a drive (not shown). The separating roller 20 acting frictionally on the top sheet of the stack by means of the roller pads 24 now tends to push that top sheet against the ramp 18. If the sheet has only slight stiffness, its front edge bends upward along the ramp 18 due to the pushing force of the separating roller 20, such that the top sheet is separated at its front edge from the stack and is pushed upward along the ramp 18 by the separating roller 20 until its front edge is grasped and taken up by a device of an office machine (not shown), for example by the platen of a printer.

If the recording media 14 have greater stiffness, the front edge of the top sheet of the stack is unable to bend along the ramp 18, and the separating roller 20 is therefore unable to advance the top sheet from the stack. As a result of the counterclockwise rotation of the separating roller 20, therefore, the separating roller 20 together with its friction roller pads 24 rolls toward the left over the top sheet of the stack being held in place by the ramp 18. Thereby the distance from the separating roller 20 to the ramp 18 increases, as does the free length of the top sheet between the ramp 18 and the line of contact of the separating roller 20, in which length the sheet is able to bend. Depending on the stiffness of the recording medium 14, the separating roller 20, in its movement toward the left (in FIG. 1), eventually reaches a distance from the ramp 18 that is sufficient to allow the front edge of the sheet to bend up along the ramp 18. As soon as the front edge bends upward along the ramp 18, the sheet is no longer held in place by the ramp 18, and the separating roller 20 can now pull the sheet from the stack and push it up along the ramp 18, so that it becomes separated in the manner described above. Since the sheet then no longer exerts any substantial resistance to the separating roller 20, the separating roller 20 no longer continues to move away from the ramp 18. The sheet pulled from the stack by the separating roller 20 and pushed upward along the ramp 18 is grasped and further transported by the office machine (not shown). The separating roller 20 resting on the sheet is thus carried along by the sheet and moved back to the initial position adjoining the ramp 18. This retraction of the separating roller 20 is supported by the restoring spring 64. A freewheel provided in the drive of the separating roller 20 permits the separating roller 20 to roll back under the action of the restoring spring 64 when the drive of the separating roller 20 is disengaged.

If the stack of recording media 14 decreases in height with the progressive removal of sheets, the separating roller 20 together with the bearing unit 52 moves downward in the slideways 58 under its own weight, so that the separating roller 20 always rests on the stack of recording media 14 with a constant pressure determined by its own weight. Since the slideways 58 are disposed parallel to the ramp 18, the distance relationships between the separating roller 20 and the ramp 18 are also constant and independent of the height of the stack of recording media 14. Thus all sheets of the entire stack, from the first to the last sheet, are separated under exactly the same conditions.

To load a new stack of recording media 14, the bearing unit 52 together with the separating roller 20 is raised up, so that the stack can be loaded and pushed against the ramp 18. In the process, the separating roller 20 is drawn by the restoring spring 64 along the slideway 58 back to the end position facing the ramp 18, so that the initial position of FIG. 1 will be restored whenever the separating roller 20 is placed on the freshly loaded stack of recording media 14.

The drive of the device (not shown in the drawing) is provided through a toothed-gear mechanism. A first toothed gear with spindle having fixed position in the housing is preferably driven by the office machine to which the recording media are being fed. In particular, this first toothed gear can engage with a toothed gear seated on the spindle of the platen of a printer, so that the drive of the device is provided through the platen control system of the printer. A first arm is pivotably mounted around the spindle of the first toothed gear. At the free end of the first arm there is hinged a bearing arm, the other end of which rotatably encircles the spindle of the separating roller 20. The first toothed gear engages with an intermediate toothed gear, which is mounted at the hinge point of the two arms. Through toothed gears mounted on the bearing arm, this intermediate toothed gear drives a toothed gear 48 seated on the separating roller 20. Because of the disposition of the toothed-gear mechanism on the hinge-connected arms, the toothed-gear mechanism can follow the movement of the separating roller 20. The first arm is disposed substantially vertically, while the bearing arm is oriented substantially horizontally. Thereby a greater range of movement is possible for the separating roller 20 and, in particular, the last toothed gear of the toothed-gear mechanism engages in a horizontal plane with the toothed gear 48 of the separating roller 20, so that the engagement pressure of this last toothed gear neither strengthens nor weakens the contact pressure of the separating roller 20, which pressure is determined by the dead weight of that roller.

FIG. 4 illustrates a further practical example of the invention.

In this practical example, the stack of recording media 14 rests on a bottom 12 having fixed position in the housing, which bottom is inclined to the horizontal at an angle of about 45°. The ramp 18 is disposed at some distance in front of the lower front edge of the bottom 12, so that a contact gap 66 is left open between the front edge of the bottom 12 and the lower edge of the ramp 18. The ramp 18 is inclined downward with respect to the vertical at the bottom 12, and points away from this bottom.

The separating roller 20 is disposed in the contact gap 66 and pressed from below on the first bottom sheet of the stack of recording media 14. Together with its spindle 26, the separating roller 20 is mounted rotatably in the free ends of bearing arms 68 disposed on both sides. The bearing arms 68 are mounted pivotably around a drive shaft 70 having fixed position in the housing, while a transverse spindle interconnects the two bearing arms 68 in torsionally stiff relationship, so that the bearing arms 68 can be swiveled only exactly parallel to each other.

The bearing arms 68 are disposed substantially perpendicular to the bottom 12 and thus to the stack of recording media 14, the length of the bearing arms 68 and thus the radius of the swiveling movement of the separating roller 20 being large compared with the swiveling distance of the separating roller 20 in the contact gap 66. The movement path of the separating roller 20 is thereby almost planar and parallel to the stack. The remaining slight circular curvature of the movement path of the separating roller 20 is not significant, since the stack of recording media 14 is not supported by the bottom 12 in the region of the contact gap 66, but instead it rests on the separating roller 20 and thereby compensates for the slight deviations from a planar movement path.

The stack of recording media 14 rests with its front edge and under its own weight on the separating roller 20. In order to ensure a uniform contact pressure of the current bottom sheet against the separating roller 20 even as the stack height decreases, a pressure plate 72 rests on the stack of recording media 14, which plate either is set in place freely or is mounted pivotably at its rear portion in the side walls 30 of the housing. The pressure plate 72 substantially determines the contact pressure of the stack against the separating roller 20, and so this contact pressure is largely independent of the stack height and is maintained even until the last sheet of the stack.

The drive of the separating roller 20 is provided by a toothed gear 74, which is mounted coaxially with the drive shaft 70 and in which the toothed gear 48 seated on the separating roller 20 engages. The drive of the toothed gear 74 is provided by the office machine (not shown) to which the recording media 14 are being fed.

In the initial position illustrated in FIG. 4, the separating roller 20 is placed against the ramp 18, so that it comes directly into contact with the first bottom sheet of the stack of recording media 14, at the point where the front edge of this sheet rests against the ramp 18. If the separating roller 20 is being driven (counterclockwise in FIG. 4), it pushes the bottom sheet of the stack against the ramp 18. If the recording media have only slight stiffness, the front edge of the bottom sheet can bend downward along the ramp 18 due to the thrusting force of the separating roller 20, so that it is detached from the stack and pushed downward along the ramp 18. Thus the sheet can be pulled individually from the stack and fed to the office machine.

If the recording media 14 have greater stiffness, the front edge of the bottom sheet is unable to bend along the ramp 18, and this ramp 18 holds the sheet in position. As a result of the drive of the separating roller and of its frictional contact with the bottom sheet of the stack, the separating roller 20 therefore rolls over the bottom sheet away from the ramp 18. Thereby the distance between the separating roller and the ramp 18 increases until the free length of the sheet between the ramp 18 and the separating roller 20 is sufficient for the sheet to be able to bend at the ramp 18 despite its stiffness and be separated in the manner described above.

When the separated recording medium 14 is grasped and further transported by the office machine, the separating roller 20 falls under its own weight back to the initial position shown in FIG. 4, in which position it presses against the ramp 18. A freewheel of the separating roller 20 brings about uncoupling from the drive for this purpose. As soon as the separating roller 20 begins to be driven once again, it automatically travels again to the position corresponding to the current stiffness of the recording media 14.

I claim:

1. Apparatus for separating sheets of recording media from a stack of sheets wherein said apparatus comprises:

a support for supporting the stack of sheets;

a ramp adjacent said support;

a separating frictional element comprising a roller, said roller being mounted for free movement of its central axis in a plane substantially parallel to the sheets of recording media;

means for rotatably driving said roller;

means for engaging a first sheet of the stack of sheets with said roller while rotatably driving said roller; and means for rolling said roller along said first sheet and away from said ramp to a distance from said ramp proportional to the stiffness of said first sheet and for frictionally driving said first sheet towards said ramp when said roller reaches said distance.

2. Apparatus according to claim 1 further including:

means for guiding movement of said roller in a direction parallel to said ramp as the height of said stack of sheets decreases.

3. Apparatus according to claim 1 wherein:

said roller has ends extending laterally of said stack of sheets; and said apparatus further includes slideways parallel to the sheets of recording media and receiving and guiding said ends.

4. Apparatus according to claim 3 further including a spindle journaling said roller;

a pinion mounted at each end of said spindle;

a rack adjacent each end of said spindle and said racks being parallel to said slideways with said pinions meshingly engaged with said racks.

5. Apparatus according to claim 1 wherein:

said support is substantially horizontal;

said ramp extends from said support in an upwardly inclined direction;

a pair of bearing units with each bearing unit positioned adjacent respective ends of said roller; and means for guiding movement of said bearing units and said roller downwardly towards said support as the height of said stack of sheets decreases, 6. Apparatus according to claim 5 wherein said roller is urged against said first sheet by the weight of said roller and the weight of said bearing units.

7. Apparatus according to claim 6 wherein said means for guiding movement of said bearing units comprises slideways, 8. Apparatus according to claim 7 wherein each of said bearing units comprises:

a spindle extending transversely to said stack of sheets;

a pinion fixed non-rotatably on each of said spindles;

a rack adjacent each of said slideways; and said pinions being meshingly engaged with respective ones of said racks, 9. Apparatus according to claim 1 further including:

a spring for resiliently urging said roller towards said ramp.

10. Apparatus according to claim 9 wherein said means for rotatably driving said roller includes a freewheel for permitting said roller to roll over the stack of sheets towards said ramp.

11. Apparatus according to claim 10, wherein said means for rotatably driving said roller comprises a plurality of gears;

said roller being connected to a gear;

one of said plurality of gears being meshingly engaged with the gear connected to said roller; and a pivotable bearing arm supporting said one of said plurality of gears and journaling said roller.

12. Apparatus according to claim 11, wherein said plurality of gears are mounted on at least two hingedly connected arms with a gear being disposed at each hinge point of said arms.

13. Apparatus according to claim 12, wherein said one of said plurality of gears is adapted to be in driving connection with the platen of a printer.

14. Apparatus according to claim 11, further including:

a pair of laterally spaced pivotably mounted rocker arms;

said roller being carried by said rocker arms, said rocker arms being substantially perpendicular to the plane of the stack of sheets, and said roller being carried by said rocker arms along a path having a radius substantially larger than the circumferential distance along said path that said roller is carried.

15. Apparatus according to claim 14, wherein said rocker arms are interconnected for joint relative movement thereof, 16. Apparatus according to claim 1, wherein said support is inclined to the horizontal and has one end lower than the other;

said ramp being spaced from the lower end of said support defining a gap between said ramp and said support;

said roller having a peripheral portion in said gap and engaging a bottom sheet of the stack of sheets placed on said support.

17. Apparatus according to claim 16, wherein said support is fixed and a movable pressure plate is provided for engaging a top sheet of the stack of sheets placed on said support.

18. Apparatus according to claim 16 further comprising:

means for mounting said roller for movement towards said ramp under its own weight.

19. A method of separating a sheet from a stack comprising:

placing a stack of sheets with an edge thereof against a ramp, engaging the first sheet of the stack with a frictional element and applying to said first sheet by said frictional element a force urging said first sheet towards said ramp, causing said frictional element to move away from said ramp proportionally to the stiffness of said first sheet until the resistance to bending of said first sheet is smaller than the force applied by said frictional element to said first sheet.

20. The method of claim 19, wherein said frictional element is a roller which rolls away from the ramp while frictionally engaged with said first sheet until said edge of the first sheet is bent upwardly by said ramp.

* * * * *